United States Patent [19]

Detweiler

[11] Patent Number: 4,940,930

[45] Date of Patent: Jul. 10, 1990

[54] DIGITALLY CONTROLLED CURRENT SOURCE

[75] Inventor: James P. Detweiler, Lansdale, Pa.

[73] Assignee: Honeywell Incorporated, Minneapolis, Minn.

[21] Appl. No.: 404,088

[22] Filed: Sep. 7, 1989

[51] Int. Cl.[5] ..... G05F 1/56

[52] U.S. Cl. ..... 323/273; 323/277; 323/280

[58] Field of Search ..... 323/265, 273, 277, 280

[56] References Cited

U.S. PATENT DOCUMENTS

| | | | |
|---|---|---|---|
| 4,251,743 | 2/1981 | Hareyama | 323/273 |
| 4,609,864 | 9/1986 | Pommer | 323/274 |
| 4,678,984 | 7/1987 | Henze | 323/277 |
| 4,750,079 | 6/1988 | Fay et al. | 323/277 |
| 4,810,948 | 3/1989 | Takuma | 323/280 |

*Primary Examiner*—Patrick R. Salce
*Assistant Examiner*—Jeffrey Sterrett
*Attorney, Agent, or Firm*—William W. Holloway; Donald J. Lenkszus; Arthur A. Sapelli

[57] ABSTRACT

A current source is controlled by the output signal from a digital to analog converter. The output signal from the digital to analog converter is applied to an amplifier unit. The output of the amplifier unit controls current through a pass transistor element, the pass transistor element current being the current applied to the load impedance. A feedback signal is generated by a differential amplifier in response to the current applied to the load impedance. The output signal from the difference amplifier is applied to an input terminal of the digital to analog converter with a polarity resulting in a change in the output signal of the amplifier unit which compensates for any change in the current through the load impedance. A voltage level changing element is included in the pass transistor control terminal to interrupt the current to the load impedance in the event of a degradation in the power supply.

20 Claims, 2 Drawing Sheets

DIGITALLY CONTROLLED CURRENT SOURCE

BACKGROUND OF THE INVENTION

1. Field of the Invention

This invention relates generally to process control circuits and, more particularly, to current sources responsive to digital signals for modulating process control devices such as valves, heaters, etc. The current sources provide analog current signals used to control temperature, flow, position, etc. as distinguished from signals used in binary applications, such as relays, lights, etc.

2. Description of the Related Art

In the related art, the use of digital to analog converter units in providing current sources has been implemented. Typically, an amplifier is used to drive the control terminal of a transistor, the transistor controlling the current through a load impedance. In certain applications, such process control applications, the value of the current through the load impedance must be controlled precisely for a digital input signal. Fluctuations in the load impedance current can be inappropriate in certain process control applications. In addition, the current source should be prevented from generating potentially destructive transient current surges in response to failure of the power supply. Digitally controlled current sources have been described in "Application Guide to CMOS Multiplying D/A Converters", copyrighted by Analog Devices Inc. The circuits of the related art do not have sufficient regulation for precision applications and can produce undesirable transients when the power supply voltage begins to fail.

A need has therefore been felt for a digitally controlled current source that provides a predetermined output current for a selected digital signal input, minimizes fluctuations in the current and prevents current surges during degradation of the circuit power supply.

FEATURES OF THE INVENTION

It is an object of the present invention to provide improved apparatus for supplying current to a load impedance.

It is a feature of the present invention to provide improved apparatus for supplying current to a load impedance controlled by digital signals.

It is yet another feature of the present invention to provide a digitally controlled current source for supplying current to a load impedance which can interrupt the load current upon degradation of a power supply providing the current.

SUMMARY OF THE INVENTION

The aforementioned and other features are attained, according to the present invention, by applying the output voltage of a digital to analog converter unit to an amplifier. The amplifier is coupled to the control terminal of a transistor, the voltage applied to the control terminal controlling the current through the transistor and through a load impedance, typically a process control element. In series with the load impedance is a resistor. The current through the load impedance flows through the resistor generating a voltage across the terminals of the resistor. The generated voltage across the resistor terminals is applied to the input terminal(s) of a difference amplifier. The output signal from the difference amplifier is applied to a feedback terminal of the digital to analog converter unit. In this manner, digital signals applied to the terminals of the digital to analog converter unit, determine the current through the load impedance and compensate for fluctuations in the load impedance current. A Zener diode is included between the amplifier and the transistor to terminate conduction of current through the transistor when the power supply fails.

These and other features of the invention will be understood upon reading of the following description along with the drawings.

DESCRIPTION OF THE PREFERRED EMBODIMENT

1. Detailed Description of the Figures

Figure 1:
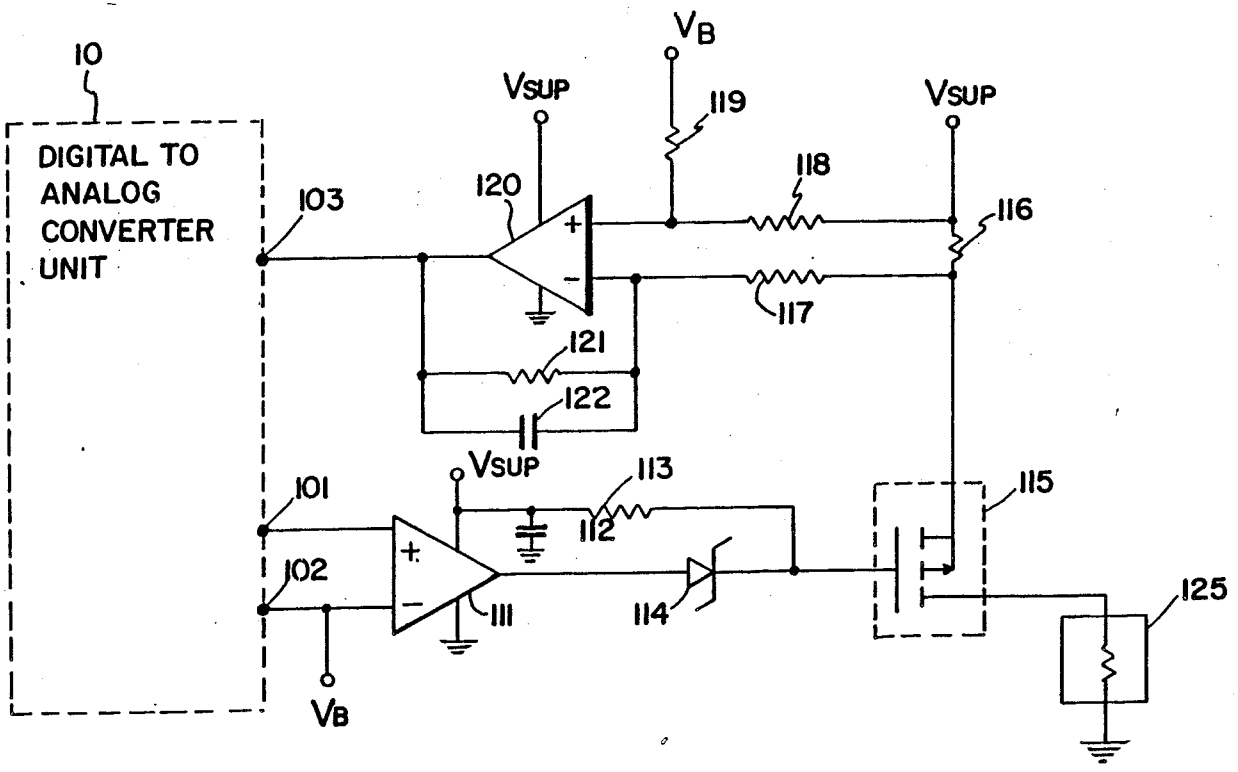
FIG. 1 is a schematic circuit diagram of the digitally controlled current source according to the present invention.

Referring now to FIG. 1, the schematic circuit of a digitally controlled current source for regulating current in a load impedance, according to the present invention, is shown. The digital to analog converter unit 10 provides an output signal between output terminal 101 and analog common terminal 102. The output terminal 101 of the digital to analog converter 10 is coupled to the positive terminal of difference amplifier 111, while the common terminal 102 of the digital to analog converter unit is coupled to the negative terminal of the difference amplifier 111. The output terminal of difference amplifier 111 is coupled to an anode terminal of Zener diode 114. A first terminal of resistor 113 is coupled to a cathode terminal of Zener diode 114, a second terminal of resistor 113 is coupled through capacitor 112 to ground potential and is coupled to power supply $V_{SUP}$. Resistor 113 causes amplifier 111 to draw current for the control of pass transistor 115 and produces a voltage across Zener diode 114. The cathode terminal of Zener diode 114 is coupled to a control element of a pass transistor 115, the control element being a gate terminal of a p channel field effect transistor (FET). The pass transistor 115 can also be a PNP bipolar transistor, the control element being a base terminal. As the difference between the voltage on the control terminal and $V_{SUP}$ increases, the current through the pass transistor increases. The drain terminal of the FET transistor 115 is coupled through load impedance 125 to the ground potential. The source terminal of the FET transistor 115 is coupled to a first terminal of resistor 116 and to a first terminal of resistor 117. A second terminal of resistor 116 is coupled to $V_{SUP}$ and to a first terminal of resistor 118. A second terminal of resistor 118 is coupled through resistor 119 to voltage $V_B$ and to a positive input terminal of amplifier 120. $V_B$ is an accurate reference voltage. A second terminal of resistor 117 is coupled to a negative input terminal of amplifier 120, through resistor 121 to an output terminal of amplifier 120, and through capacitor 122 to the output terminal of amplifier 120. The output terminal of amplifier 120 is coupled to a feedback terminal 103 of digital to analog converter unit 10. The ground terminal 102 of the digital to analog converter unit 10 and the negative terminal of difference amplifier 111 are also coupled to voltage $V_B$.

Figure 2:
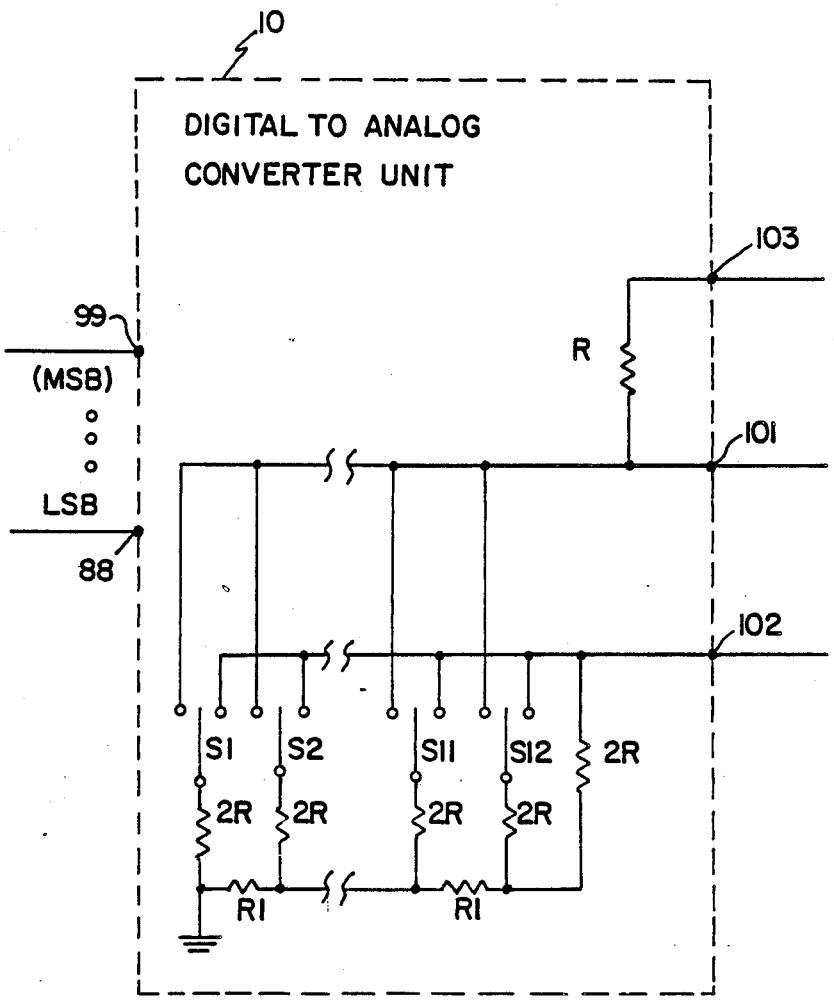
FIG. 2 is partial schematic diagram for illustrating the operation of the digital to analog converter.

Referring to FIG. 2, the operation of the digital to analog converter 10 is illustrated. The internal network of the digital to analog converter can be comprised of an R-2R network of resistors coupled to a plurality of switches $s_1$–$s_{12}$. A group of digital signals is applied to terminals 88–99. The digital signals applied to terminals 88–99 determine the position of the switches $s_1$–$s_{12}$. The setting of the switches determines the amount of current drawn from node 101, which in turn determines the voltage between the output terminals 101 and 102 of the digital to analog converter. This voltage difference is applied to the input terminals of amplifier 111 for control of the current flowing through transistor 115.

2. Operation of the Preferred Embodiment

The operation of the present invention can be understood in the following manner. After the circuit of the present invention has reached an equilibrium condition for a given set of digital signals applied to terminals 88–99, a new set of digital signals applied to terminals 88–99 causes a change in the amount of current to be drawn from terminal 101 of the digital to analog converter unit 10. The change (increase or decrease) in the amount of current is determined by whether the new digital word applied to digital to analog converter 10 is larger or smaller than the prior word. The voltage at terminal 101 will rise or fall depending on the relationship of new digital word to the prior digital word. The amplifier 111 will increase or decrease the voltage applied to the control element of transistor 115, thereby increasing or decreasing the current through resistor 116. The output of difference amplifier 120 increases or decreases the voltage level at terminal 103 of digital to analog converter unit 10 until equilibrium is reestablished for the voltage across the input terminals of amplifier 111.

Once equilibrium is established, then any change in the current through resistor 116 will be compensated for by adjustment of the current through transistor 115. The capacitor 122 provides stability against oscillation of the feedback loop. A resistor in series with capacitor 122 can be added to further improve stability.

The Zener diode 114 is used to respond to the situation where the power supply voltage $V_{SUP}$ (typically 24 volts in the circuit of the present invention) is failing. The Zener diode 114 forces the transistor 115 to stop conducting current when the supply voltage $V_{SUP}$ falls below a certain value. The interruption of the current causes the associated process control device (i.e., load impedance 125) to be turned off, the fail-safe condition.

Representative values of components are the following: resistor 113 is 110 k Ohms; resistor 116 is 100 Ohms; resistor 118 is 129.2 k Ohms; resistor 119 is 339.2 k Ohms and resistor 121 is 339.2 Ohms. In FIG. 2, R1 is typically equal to R. These values are representative and, as will be clear to those skilled in the art, other component values can be used in practicing the present invention.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the invention.

What is claimed is:

1. A digitally controlled current source for controlling a current through a load impedance, said current source comprising:

a digital to analog converter unit:

an amplifier circuit for amplifying an output voltage of analog to digital converter unit;

a transistor having an output signal from said amplifier circuit applied to a control element of said transistor;

a resistor coupled in series with said transistor and with said load impedance; and a difference amplifier having input terminals coupled across said resistor, an output signal of said difference amplifier applied to said digital to analog converter unit, said output signal of said digital to analog converter being a function of said difference amplifier output signal.

2. The digitally controlled current source of claim 1 further comprising a Zener diode coupled between said amplifier circuit and said transistor control element.

3. The digitally controlled current source of claim 2 wherein a reference voltage is coupled to a negative input terminal of said amplifier circuit and is coupled to a positive input terminal of said difference amplifier.

4. The digitally controlled current source of claim 3 wherein said transistor is selected from a group consisting of a p channel FET device and PNP bipolar transistor.

5. The digitally controlled current source of claim 4 wherein said load impedance provide a multiplicity of states, a load impedance state being controlled by current through said load impedance.

6. The digitally controlled current source of claim 5 further comprising a capacitor between an output terminal and a negative input terminal of said difference amplifier, said capacitor reducing instability in said digitally controlled current source.

7. The digitally controlled current source of claim 2 wherein a group of digital signals applied to said digital to analog converter unit determines a current through said resistor.

8. A method of digitally controlling a current, said method comprising the steps of:

amplifying a output voltage of a digital to analog converter unit with an open-ended difference amplifier to provide a first amplified signal;

controlling said current by means of said first amplified signal;

amplifying a signal proportional to said current by a feedback amplifier to provide a second amplified signal;

applying said second amplified signal to a feedback terminal of said digital to analog converter unit.

9. The method of claim 8 further comprising a step of halting said current when a supply voltage begins to fail.

10. The method of claim 9 further comprising a step of stabilizing said current against oscillations.

11. The method of claim 9 further comprising a step of determining a value of said current by applying digital signal groups to said digital to analog converter unit.

12. A digitally controlled current source for controlling a current through a load impedance, said current source comprising:

a reference impedance coupled in series with said load impedance;

a first amplifier having input terminals coupled across said reference impedance;

a digital to analog converter unit having a feedback terminal coupled to said first amplifier;

a second amplifier having input terminals coupled to output terminals of said digital to analog converter unit; and a current control device coupled in series with said load impedance, wherein said second amplifier has an output terminal coupled to a control terminal of said current control device, an output signal from said second amplifier determining a value of a current through said current control device.

13. The current source of claim 12 wherein digital signals applied to input terminals of said digital to analog converter unit determine said value of current through said load resistor.

14. The current source of claim 13 further comprising a Zener diode coupled between an output terminal of said second amplifier and a control terminal of said current control device, said Zener diode halting current flow through said current control device and through said load impedance when a power supply energizing said current source begins to fail.

15. The current source of claim 14 wherein said current control device is one of the group selected from an PNP bipolar transistor and a p channel FET transistor.

16. The current source of claim 15 wherein said first amplifier is configured as a feedback amplifier and said second amplifier is configured as an open ended amplifier.

17. The current source of claim 16 further comprising a reference voltage coupled to an inverting input terminal of said second amplifier and to non-inverting terminal of said first amplifier.

18. The current source of claim 17 wherein said first amplifier includes a capacitor coupled in a feedback configuration for increasing a frequency stability of said current source.

19. The current source of claim 18 wherein a cathode terminal of said Zener diode is coupled to said second amplifier and an anode terminal of said Zener diode is coupled to said control terminal of said current control device.

20. The current source of claim 19 wherein said current control device is coupled between said reference impedance and said load impedance.

* * * * *